United States Patent [19]

Minami et al.

[11] 4,060,064

[45] Nov. 29, 1977

[54] VARIABLE SIZE VENTURI CARBURETOR WITH AN ELECTRONIC AIR/FUEL RATIO CONTROL SYSTEM

[75] Inventors: Hidehiro Minami, Yokohama; Hideo Kamino, Chofu, both of Japan

[73] Assignee: Nissan Motor Company, Limited, Yokohama, Japan

[21] Appl. No.: 668,072

[22] Filed: Mar. 18, 1976

[30] Foreign Application Priority Data

Mar. 20, 1975 Japan ..... 50-38593

[51] Int. Cl.[2] ..... F02M 7/00

[52] U.S. Cl. ..... 123/119 EC; 261/44 R; 261/71; 261/121 B

[58] Field of Search ..... 60/276; 123/119 R, 119 EC, 123/119 D, 124 B; 261/121 B, 44 R, 39 A, 39 B, DIG. 38, 71

[56] References Cited

U.S. PATENT DOCUMENTS

| | | | |
|---|---|---|---|
| 1,107,713 | 8/1914 | Shakespeare | 261/71 |
| 1,196,976 | 9/1916 | Pembroke | 261/71 |
| 1,328,590 | 1/1920 | Royce | 261/71 |
| 1,634,461 | 7/1927 | Grikscheit | 261/44 R |
| 2,868,522 | 1/1959 | O'Neil | 261/DIG. 38 |
| 3,684,257 | 8/1972 | Lawrence | 261/44 R |
| 3,875,917 | 4/1975 | Scarritt | 261/44 R |
| 3,880,962 | 4/1975 | Rhodes | 261/121 B |
| 3,925,521 | 12/1975 | Otani | 261/121 B |
| 3,963,009 | 6/1976 | Mennesson | 60/276 |

FOREIGN PATENT DOCUMENTS

| | | | |
|---|---|---|---|
| 389,109 | 2/1924 | Germany | 261/71 |
| 660,311 | 11/1951 | United Kingdom | 261/121 B |

*Primary Examiner*—Douglas Hart

[57] ABSTRACT

The position of a fuel nozzle of a variable size venturi carburetor is adjustable with respect to the venturi orifice in dependence on climatic conditions such as an ambient temperature and/or atmospheric pressure. An additional air delivery passageway controllable by an electronic air/fuel ratio control system in dependence on an exhaust gas sensor signal is connected with the fuel nozzle.

5 Claims, 4 Drawing Figures

VARIABLE SIZE VENTURI CARBURETOR WITH AN ELECTRONIC AIR/FUEL RATIO CONTROL SYSTEM

This invention relates generally to a variable size venturi type carburetor for metering air and fuel of an air/fuel mixture being charged into the engine and more particularly to a carburetor of the type described above with an electrically operable air/fuel ratio correction control for providing an optimum air/fuel ratio such as stoichiometric at which the engine harmful gas emission control is most efficient.

In general, a range of air/fuel ratios of the mixture in which exhaust emission control as by a catalytic converter is most efficient is very narrow near stoichiometric ratio. In order to control the air/fuel ratio so precisely, there is proposed a so-called closed loop air/fuel ratio control system in which an exhaust gas sensor signal provides a measure of whether the air/fuel ratio is at the stoichiometric level or whether a rich or lean correction in the carburetor is required.

The air/fuel ratio is then controlled, for instance, by admitting additional air into the fuel delivery passage of the carburetor at a rate controlled in accordance with the exhaust gas sensor signal. A variety of such closed loop systems have been proposed to be used with electronic fuel injection or a fixed size venturi type carburetor. I have sought to realize similar or superior advantageous expedients by applying such a closed loop system to a variable size venturi carburetor with an appropriate structural modification.

When using a variable size venturi carburetor with a closed loop system, a difficulty is encountered in that the carburetor of this type is liable to be influenced by variation of the environmental temperature and/or atmospheric pressure. Among several reasons for this is that in such a carburetor liquid fuel in a fuel passage carrying a fuel nozzle has to keep contact not only with an inner peripheral wall surface of the fuel passage in the carburetor body but also with an outer periphery of a metering needle controlling the open area of the fuel nozzle, which is made of a metal highly sensitive to the ambient temperature. As by way of example, the temperature rises, the viscosity of liquid fuel is reduced so that an increased amount of fuel is drawn into the venturi since the venturi suctions is substantially kept constant. A resultant air/fuel ratio therefore greatly deviates from the preset level.

Such deviation can be compensated for to some extent by utilizing the closed loop system as previously mentioned. However, if such deviation is too great, a control range from the improper air/fuel ratio to a stoichiometric one is so wide that a stable operation of the engine is no longer maintained. Particularly in a closed loop system of the type delivering additional air to the carburetor through an alternately opening and closing electromagnetic valve, the air/fuel ratio upon opening of the valve instantaneously varies from that upon closure of the valve by an increased rate, causing an undesirable hunting of the engine. For this reason, it is rather undesirable to compensate for a variation of ambient temperature solely by means of a closed loop air/fuel ratio control system.

It is therefore a general object of this invention to provide a novel combination of an improved variable size venturi type carburetor with an electronic closed loop air/fuel ratio control system.

Another object of this invention is to provide a combination of the character above which is free from any difficulty or drawback previously mentioned.

A further object of this invention is to provide an improved variable size venturi carburetor in which the position of a fuel nozzle with respect to the venturi is adjustable in dependence on variation in the ambient temperature and/or atmospheric pressure and which is combined with an electronic closed loop air/fuel ratio control system having an additional air delivery passage which constantly communicates with a fuel delivery passage of the carburetor irrespectively of the ambient temperature and/or atmospheric pressure.

According to one feature of this invention, a tubular member is fitted in a fuel delivery passage through which fuel is discharged from a fuel reservoir into a venturi defined between a conventional suction responsive piston and a wall of the carburetor bore. The tubular member, carrying a fuel nozzle, is axially movable relative to the carburetor body manually or automatically in dependence on ambient temperature and/or atmospheric pressure. A conventional metering needle extends from the suction piston into the tubular member and is axially movable relative to the tubular member for controlling the effective open area of the fuel nozzle.

Another feature of this invention is that an elongate vertical groove is formed at the wall exterior of the tubular member or at the wall interior of the fuel delivery passage. An additional air delivery passage of the closed loop system extending through the carburetor body communicates with the fuel nozzle through the elongate groove so that additional air is constantly delivered independently of the axial movement of the tubular member.

Other objects, features and various advantages of this invention will be readily understood from the following detailed description of this invention with reference to the appended claims and drawings, in which:

Throughout the Figures, like reference characters indicate like and corresponding parts in the several preferred embodiments.

Figure 1:
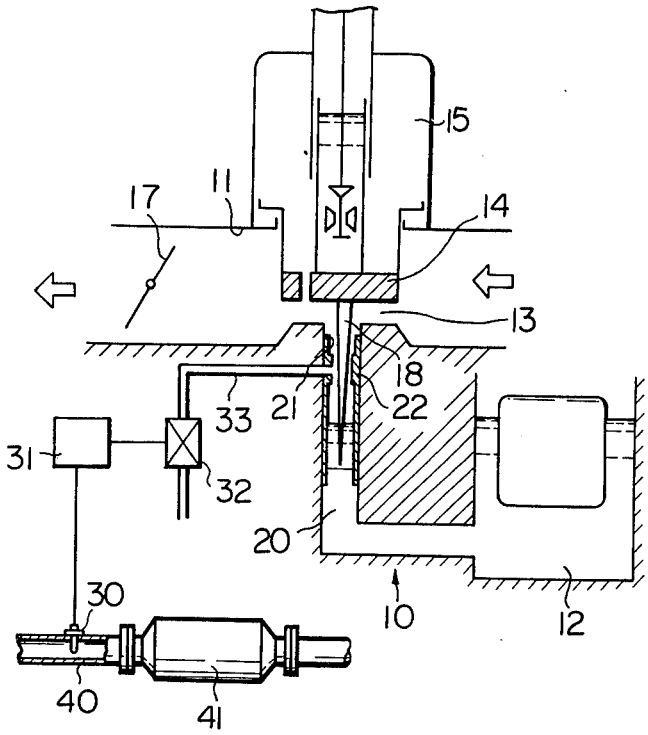
FIG. 1 is a schematic view showing a variable size venturi type carburetor combined with an electronic closed loop air/fuel ratio control system.

With reference to FIG. 1, the carburetor broadly comprises a body 10 defining a carburetor bore 11 and a chamber 12 in which fuel is maintained at a constant level in a conventional manner by means of a float valve (no number). A venturi 13 is defined by the bore wall and a suction responsive piston 14 projecting into the bore 11. A suction chamber 15 on the upper side of piston 14 is placed in communication with the bore 11 of the carburetor downstream of the venturi 13 by a calibrated passage (no number) in the piston 14.

A throttle valve 17 of conventional butterfly type is located downstream of the piston 14. The piston carries a calibrated needle 18 which projects through a fuel nozzle 21 to which fuel is supplied from the chamber 12 via nozzle carrying member 22 in a fuel delivery passage 20. The nozzle 21 directly opens to the venturi 13 just beneath the underside of the piston 14.

An electronic closed loop control system conventionally comprises an exhaust gas sensor 30 disposed in an exhaust passage 40 for instance of zirconium dioxide sensing the concentration of oxygen contained in the exhaust gases and producing a signal proportional to the sensed oxygen concentration. Designated by numeral 41 is a so-called three way catalytic converter in the passage 40 which is capable of reducing $NO_x$ as well as oxidizing HC and CO provided that the air/fuel ratio is controlled near stoichiometric. A control circuit 31 receives the exhaust gas sensor signal and detects deviation of the sensor signal indicating the real air/fuel ratio from the stoichiometric one producing an output correction signal. An additional air delivery passage 33 is placed in constant communication with the nozzle carrying member 22 in the fuel delivery passage above the level of liquid fuel, preferably in the vicinity of the nozzle 21. The passage 33 is controlled by a control valve 32 preferably of electromagnetic type which opens and closes in response to the correction signal from the control circuit 31. As a result, the rate of additional air and therefore of fuel drawn from the chamber 12 through the fuel nozzle 21 are optimumly adjusted to maintain the stoichiometric air/fuel ratio.

Figure 2:
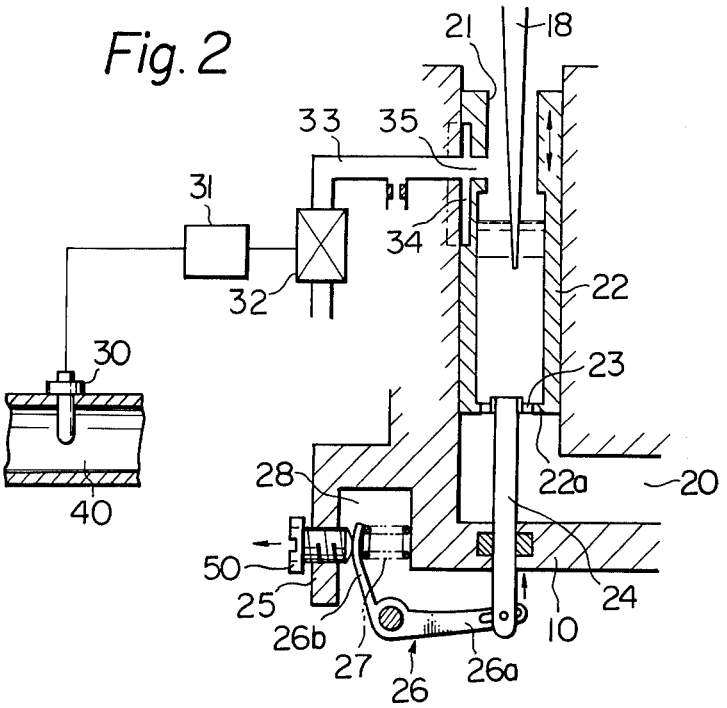
FIG. 2 shows a first preferred embodiment of this invention.

Referring to the embodiment of FIG. 2, the nozzle carrying member 22 consists of a bottom-end closed tube axially slidably fitted in the fuel passage 20. The bottom **22*a* of the tubular nozzle carrying member defines therethrough two or more fuel inlet orifices 23 through which fuel from the chamber 12 is drawn into the nozzle carrying tube 22**.

To the bottom end of the tube **22*a* is fastened an operating rod 24 which extends through the wall of the fuel delivery passage 20 outwardly of the carburetor body 10. Adjacent the fuel passage 20, a headed adjusting screw 25 is threaded into the carburetor body wall, the leading end of the screw being protractable into and withdrawable from a cavity 28 formed in the carburetor body by turning movement thereof. A linkage 26 in the form of an L-shaped lever is provided between the adjusting screw 25 and the operating rod 24 and has one arm 26*a* connected to the tip of the operating rod 24 through a pin and a slot and the other arm 26*b* abutting against the end face of the screw 25 by a preloaded spring 27. It is apparent that by turning the screw, the operating rod 24 together with the tube 22 moves up and down in the fuel passage 20**.

There is formed an elongate vertical groove 34 at the outer surface of the tube 22, the length of which is set to be equal to or longer than the maximum stroke of the up and down movement of the tube 22. The groove 34 has an opening 35 provided in substantial alignment with the air passage 33 thus forming part thereof. The air passage 33 thus communicates with the fuel nozzle 21 through the vertical groove 34 and the opening 35 so that air delivery takes place at any vertical position of the tube 22. The vertical groove 34 may be located at any suitable part, for instance, at the inner surface defining the fuel delivery passage 20 of the body, as indicated by a phantom line in FIG. 2.

When in operation the ambient temperature is high as in summer, the vehicle operator or a service man has only to turn the screw 25 to withdraw it from the cavity 28, whereupon spring 27 force raises the tube 22 with the operating rod 24. The space between the tapering needle 18 and the tube interior, that is, the open area of the nozzle 21 is somewhat reduced with respect to the same position of the tapering needle 18. It would be convenient if a scale 50 indicating the year round temperature degrees can be carried on the head surface of the screw 25.

Since the temperature rise and fall is thus compensated for, a deviation of the air/fuel ratio from a preset proper level, though not stoichiometric, is not more than that at a conventional fixed-venturi type carburetor. The air/fuel ratio set by the carburetor in dependence on the ambient temperature is then finely controlled to the stoichiometric by the closed loop system previously mentioned without influencing a stable operation of the engine.

Figure 3:
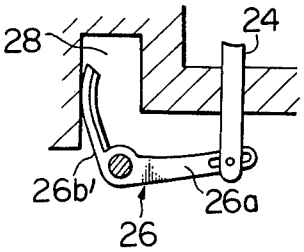
FIG. 3 shows a second preferred embodiment of this invention.

In FIG. 3 another preferred embodiment is shown which is different from the embodiment of FIG. 2 in that the other arm **26*b*' of the L-shaped lever 26 is formed by an element deformable by a change in temperature such as a bimetal, which bears against the wall of the cavity 28. Ascending and descending of the tube 22** therefore takes place fully automatically in dependence on change in temperature.

Figure 4:
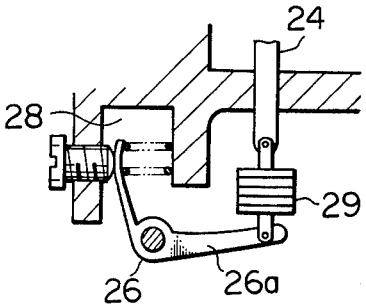
FIG. 4 shows a third preferred embodiment of this invention.

According to the embodiment of FIG. 4, the tube 22 is movable not only in dependence on the temperature but also in dependence on the atmospheric pressure. In practice, a pressure responsive element such as a bellows 29 is mounted between the operating rod 24 and the L-shaped lever 26. Accordingly, a proper air/fuel ratio is maintained while the vehicle is running at variable altitudes.

It would be readily understood that throughout the embodiments, the variable size venturi carburetor of this invention is convenient not only for climatic air/fuel ratio control but also fine idle adjustment. Also, it can be employed in place of a conventional type choke plate mounted on a spindle which is employed during cold starting to temporarily enrich the mixture.

What is claimed is:

1. In a variable size venturi carburetor of an internal combustion engine with an electronic air/fuel ratio control system operable in accordance with at least one engine operating variable and having a body defining a bore, a suction responsive piston projecting into the bore to form a venturi and movable in response to the suction adjacent the venturi to be withdrawn from the bore, a fuel delivery passageway in the body through which fuel is discharged from a reservoir to the venturi, a metering needle valve extending from the suction responsive piston across the venturi into the fuel delivery passageway, and additional air delivery passageway being controlled by the electronic air/fuel ratio control system, the improvement comprising; a tubular nozzle carrying member vertically slidably fitted in the fuel delivery passageway and in constant communication with said additional air delivery passageway and means for manually vertically displacing said nozzle carrying member relative to the body to adjust the position of the nozzle with respect to the venturi, a manual adjusting screw having indicating means mounted in the carburetor body and linkage means to transfer the adjustment of the adjusting screw to the nozzle carrying member to move the same relative to the body, said linkage means having an L-shaped pivotal lever having one arm abutting against one end of the adjusting screw opposite to the screw head and the other arm operatively linked with the bottom of the tubular nozzle carrying member.

2. A carburetor according to claim 1, further comprising pressure responsive means being deformable in dependence on the atmospheric pressure and provided between the nozzle carrying member and the linkage means to displace the nozzle carrying member in dependence on the deformation of the pressure responsive means.

3. A carburetor according to claim 1, in which the nozzle carrying member has at its outer wall surface an elongate groove extending longitudinally thereof, via which the additional air delivery passageway extends through the wall of the nozzle carrying member opening to the nozzle, said elongate groove having length at least equal to the maximum stroke of displacement of the nozzle carrying member.

4. A carburetor according to claim 1, in which the carburetor body has at its inner surface defining the fuel delivery passage an elongate groove extending longitudinally thereof, via which the additional air delivery passageway extends through the wall of the nozzle carrying member opening to the nozzle, said elongate groove having a length at least equal to the maximum stroke of displacement of the nozzle carrying member.

5. A carburetor according to claim 1 in which the adjusting screw has a scale indicating year round temperatures on its head.

* * * * *